US005397168A

United States Patent [19]

Hand

[11] Patent Number: 5,397,168

[45] Date of Patent: Mar. 14, 1995

[54] CHAIR WITH ADJUSTABLE BACKREST

[75] Inventor: Joseph M. Hand, Sheboygan Falls, Wis.

[73] Assignee: Bemis Manufacturing Company, Sheboygan Falls, Wis.

[21] Appl. No.: 116,499

[22] Filed: Sep. 2, 1993

[51] Int. Cl.[6] ..... B60N 2/02

[52] U.S. Cl. ..... 297/356; 297/367

[58] Field of Search ..... 297/356, 357, 366, 367

[56] References Cited

U.S. PATENT DOCUMENTS

| | | | |
|---|---|---|---|
| 1,005,064 | 10/1911 | Palmer | 297/357 |
| 3,186,253 | 6/1965 | Ramillon | 74/540 |
| 3,698,764 | 10/1972 | Geddings | 297/356 |
| 4,354,710 | 10/1982 | Rauschenberger | 297/356 |
| 4,640,549 | 2/1987 | Yokota | 297/410 |
| 4,709,961 | 12/1987 | Hill | 297/284 |
| 4,733,913 | 3/1988 | Tateyama | 297/409 |
| 4,930,186 | 6/1990 | Linwu | 16/325 |
| 5,169,257 | 12/1992 | Liou | 297/356 |

FOREIGN PATENT DOCUMENTS

| | | | |
|---|---|---|---|
| 9101667 | 2/1991 | European Pat. Off. . | |
| 1149761 | 4/1969 | United Kingdom | 297/356 |

OTHER PUBLICATIONS

Festival Leisure Furniture, Model 4040, Folding Lounge, ©1990 Bemis Mfg. Co.

Lawn Comfort, Model 4030 Antia Folding Lounge, ©1990 Bemis Mfg. Co.

Lawn Comfort, Model 4210 Ancolia Stack Lounge, ©Bemis Mfg. Co., Pamphlet No. O-B-702-2004.

Festival Leisure Furniture, Model 4010 Lounge, ©1990 Bemis Mfg. Co.

Lawn Comfort, Model 4045 Carma Folding Lounge, ©1992 Bemis Mfg. Co., Pamphlet No. O-B-702-2005.

Festival Leisure Furniture, Replacement Parts List for Model Number 4030, Oct. 1991, Pamphlet No. OB-70-2-8015.

Festival Leisure Furniture, Replacement Parts List for Model Number 4040, Nov. 1992, Pamphlet No. OB-70-2-8004.

Festival Leisure Furniture, Replacement Parts List for Model Number 4045, Nov. 1992, Pamphlet No. OB-70-2-8030.

Festival Leisure Furniture, Replacement Parts List for Model Number 4010, Sep. 1990.

Lawn Comfort Instructions for Use-Briza, p. 18.

*Primary Examiner*—F. Daniel Lopez

*Attorney, Agent, or Firm*—Michael, Best & Friedrich

[57] ABSTRACT

A seating apparatus including a frame, a member supported by the frame for movement relative thereto, a ratchet mechanism for affording movement of the member relative to the frame in a first direction from a first extreme position through a range of positions to a second extreme position and for preventing movement of the member relative to the frame in a second direction opposite to the first direction, the ratchet mechanism including a ratchet, and a one-piece pawl including a first portion engageable with the ratchet and a resilient portion for biasing the pawl into engagement with the ratchet, and a release mechanism for completely disengaging the ratchet and the pawl when the member is moved into the second extreme position.

24 Claims, 3 Drawing Sheets

CHAIR WITH ADJUSTABLE BACKREST

BACKGROUND OF THE INVENTION

1. Technical Field

The invention relates generally to chairs having an adjustable backrest, and more specifically to chairs having a ratchet mechanism associated with the adjustable backrest.

2. Related Prior Art

It is generally known to provide chairs with a backrest that can be moved into various positions so as to increase the comfort of a person using the chair. It is also generally known to provide such chairs with a ratchet mechanism associated with the backrest so that the backrest is movable through a range of positions in a first direction but is prevented from moving in a direction opposite to the first direction. U.S. Pat. No. 4,354,710 illustrates a chair design providing a movable backrest and a ratchet mechanism associated with the backrest.

SUMMARY OF THE INVENTION

The invention provides a chair including a frame and a backrest supported by the frame for pivotal movement through a range of positions between a first extreme or lower position and a second extreme or upper position. The chair includes a ratchet and a pawl, which pawl is movable between an engaged position to prevent downward or backward movement of the backrest relative to the frame and a disengaged position wherein the pawl is spaced away from the ratchet to afford free movement of the backrest through the range of positions.

The chair also includes a first resilient means for biasing the pawl toward the engaged position and means on the backrest for moving the pawl into the disengaged position when the backrest is in the upper position. The first resilient means is preferably a leaf spring that is an integral part of the pawl. A latch is also supported by the frame for movement between an unlatched position wherein the latch is disengaged from the pawl (so that the pawl is biased to its engaged position) and a latched position wherein the latch retains the pawl in its disengaged position to allow free movement of the backrest to the lower position. A second resilient means biases the latch toward the latched position. The second resilient means is preferably an integral part of the latch. A rib on the backrest engages the latch to move the latch into the unlatched position (which allows the pawl to return to its engaged position) when the backrest is in the lower position.

A principal feature of the invention is the provision of a chair having an adjustable backrest and a ratchet mechanism that has a fairly simple construction and requires relatively few parts.

Another feature of the invention is the provision of a chair having an adjustable backrest and a ratchet mechanism that is light-weight and is made entirely of plastic, thereby providing an adjustable backrest mechanism which is impervious to corrosion.

Another feature of the invention is the provision of a chair having an adjustable backrest and an associated ratchet mechanism all of which can be made of plastic by injection molding.

Other features and advantages of the invention will become apparent to those skilled in the art upon review of the following detailed description, claims and drawings.

Figure 1:
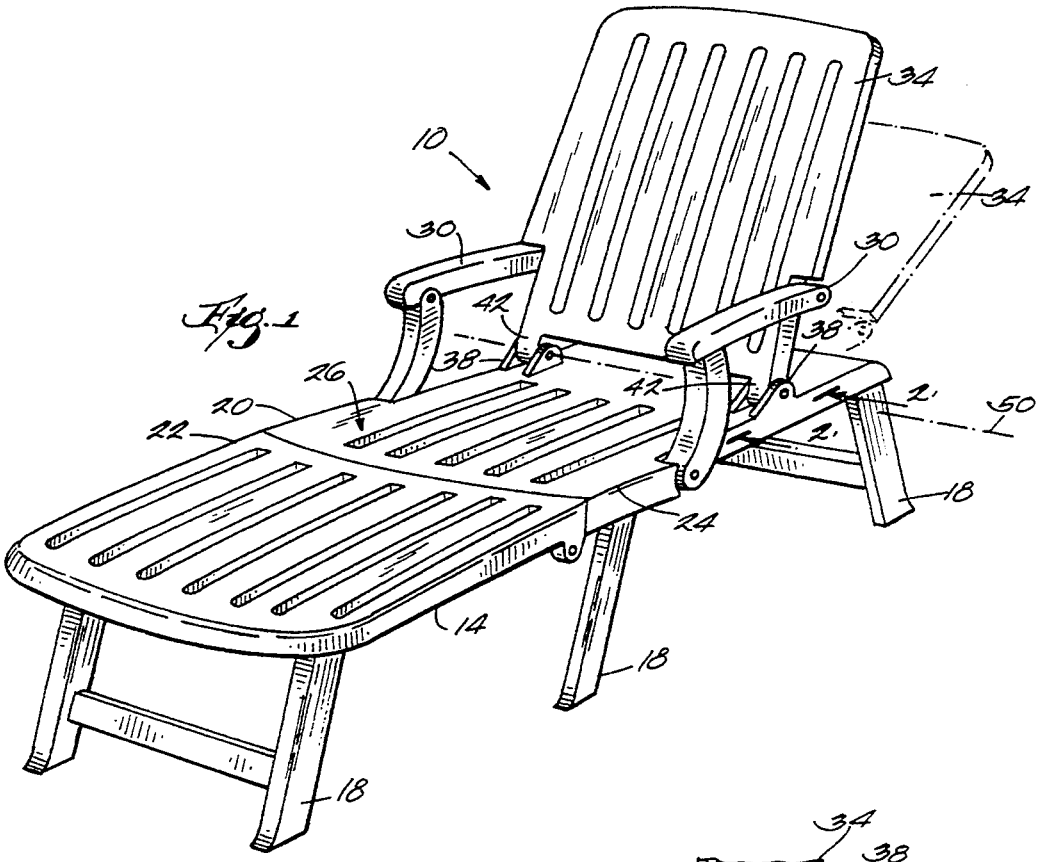
FIG. 1 is a perspective view of a chair embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A lounge or chair 10 embodying the invention is illustrated in the drawings. In the preferred form of the invention, the chair 10 and all of its components are injection molded plastic. As shown in FIG. 1, the chair 10 includes a frame 14 having several pairs of legs 18 supporting a generally horizontal seating portion 20. The seating portion 20 includes opposite side edges 22 and 24 and an upper surface 26 defining a seat.

Figure 7:
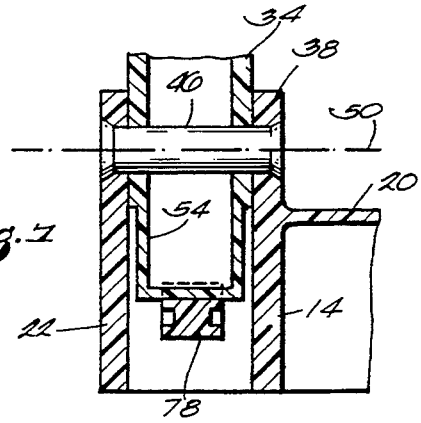
FIG. 7 is a view taken along line 7—7 in FIG. 2.

The chair 10 also includes a pair of armrests 30 supported in part by the frame 14 and supported in part by a backrest 34 that is pivotally connected to the frame 14. In particular, the chair 10 has a pair of clevises 38 extending upwardly from the seating portion 20. Each clevis 38 is located adjacent a respective edge 22 or 24 of the seating portion 20. The lower portion of the backrest 34 includes a pair of extensions 42, each of which is received by a respective clevis 38 and each of which is pinned to the clevis 38 by a hinge pin 46 (FIG. 7).

The backrest 34 is pivotal about a hinge axis 50 defined by the hinge pins 46, and the backrest 34 pivots between a first extreme or lower position (FIG. 6) wherein the backrest 34 is substantially horizontal and lies against the frame 14 rearwardly of the seat 26 and a second extreme or upper position (FIG. 4) wherein the backrest 34 is generally upright. While the illustrated chair 10 is in the form of a chaise, it should be readily understood that the chair 10 could be in any form having a frame and a member connected thereto for pivotal movement relative to the frame 14.

Figure 2:
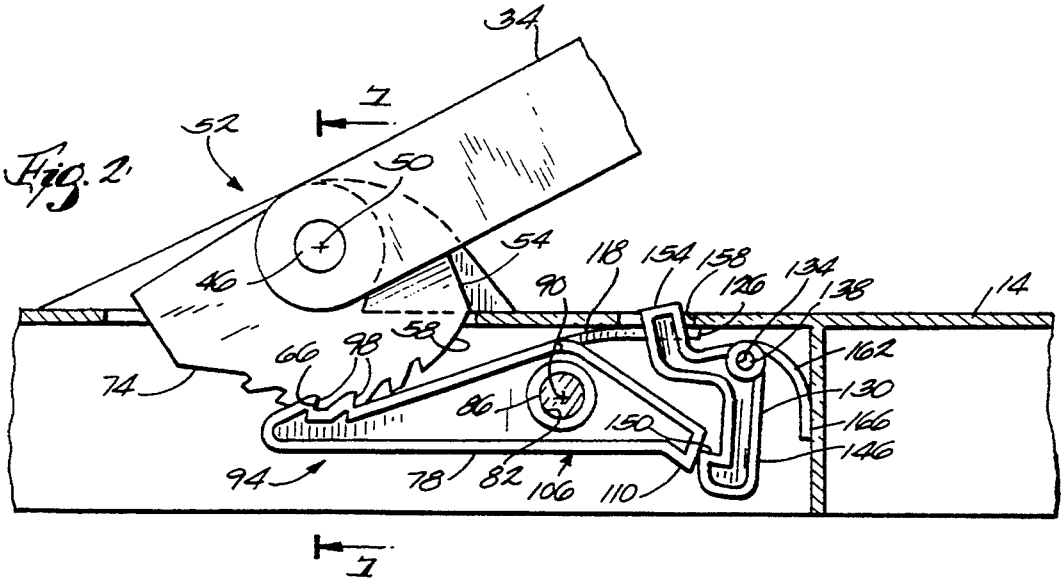
FIG. 2 is an enlarged, cross-sectional view taken generally along line 2—2 in FIG. 1.
Figure 3:
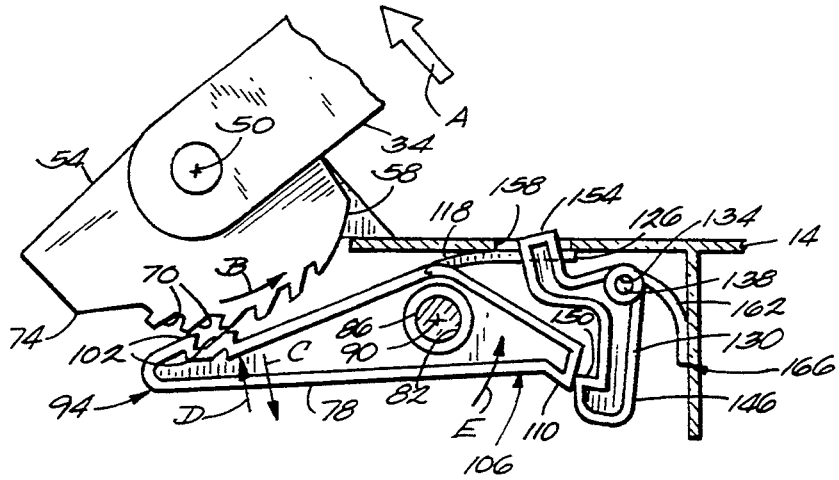
FIG. 3 is a view similar to FIG. 2 showing the backrest in a second position.
Figure 4:
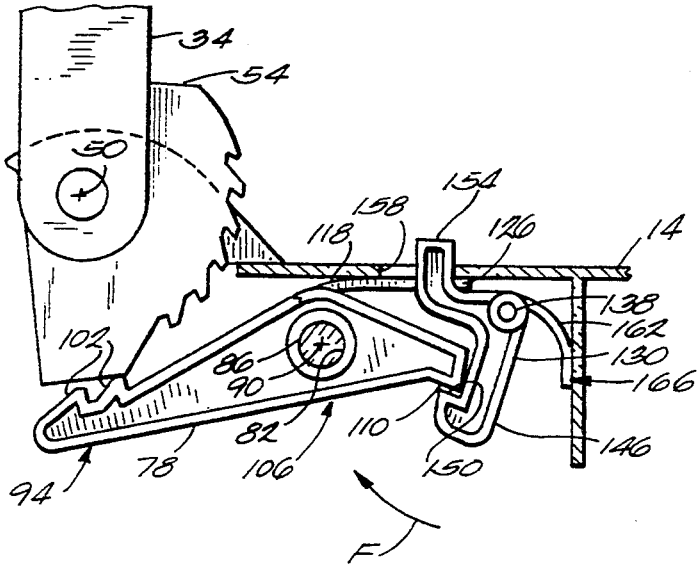
FIG. 4 is a view similar to FIG. 2 showing the backrest in a third position.

As illustrated in FIGS. 2–6, the chair 10 also includes a ratchet mechanism or means 52 for affording movement of the backrest 34 relative to the frame 14 in a first, counterclockwise direction (in the direction of Arrow "A" in FIG. 3) from the lower position (FIG. 6) through a range of positions to the upper position (FIG. 4). The ratchet means 52 also prevents movement of the backrest 34 relative to the frame 14 in a second, clockwise direction (opposite to Arrow "A" in FIG. 3) which is opposite to the first direction. While the chair 10 preferably has ratchet means 52 on both sides of the backrest 34, i.e., adjacent both edges 22 and 24 of the seating portion 20, only the ratchet means 52 adjacent the edge 24 will be described.

While various suitable constructions for the ratchet means 52 could be readily used, in the illustrated embodiment, the ratchet means 52 includes (see FIG. 2) a ratchet 54 located on the lower portion of the backrest 34 adjacent the hinge pin 46. The ratchet 54 is fixed to the backrest 34 and pivots in common with the backrest 34 about the hinge axis 50.

Figure 9:
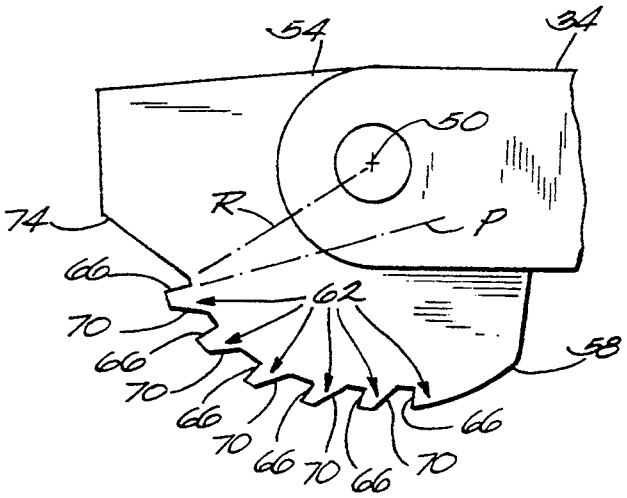
FIG. 9 is an enlarged view of the ratchet shown in FIG. 2.

In particular, and as best shown in FIGS. 2–6 and 9, the ratchet 54 has a surface 58 defining a plurality of ratchet teeth 62 arranged in an arcuate pattern. Referring specifically to FIG. 9, each ratchet tooth 62 has an outwardly extending "leading" face 66 which is undercut so that it lies in a plane that extends at a slight negative angle relative to a radius extending from axis 50. One such radius is shown in FIG. 9 as radius "R". The associated plane is illustrated schematically in FIG. 9 as line "P". Each ratchet tooth also has a "trailing" surface 70 lying in a plane (not shown) that extends at a slight positive angle relative to a radius from axis 50. Together, the leading faces 66 and trailing surfaces 70 form the series of teeth 62 on the ratchet 54.

The ratchet 54 also includes a cam surface 74 which is located at one end of the arcuate surface 58 and which extends radially away from the ratchet pivot axis 50 a distance greater than the radial distance from the pivot axis 50 to the ratchet teeth 62 so that the cam surface 74 is eccentric to the surface 58 on which the ratchet teeth 62 are formed. The purpose and function of the cam surface 74 will be described below in greater detail.

The ratchet means 52 also includes (see FIGS. 2 and 8) a one-piece pawl 78 that is engageable with the ratchet 54. The pawl 78 is basically a lever and has extending therethrough a centrally located bore 82. The bore 82 receives a pivot pin 86 which is fixed to the frame 14. The pivot pin 86 defines a pivot axis 90 and affords pivotal movement of the pawl 78 about the pivot axis 90 relative to the frame 14 and relative to the ratchet 54. The pawl 78 has a first portion 94 that is grooved to provide a pair of tooth-like ratchet engaging surfaces 98 that are adapted to engage the leading faces 66 of the ratchet teeth 62. Preferably, each ratchet engaging surface 98 is appropriately arranged to complement the negative angle at which each leading face 66 extends. When a ratchet engaging surface 98 mates with a leading face 66 of an associated ratchet tooth, a camming action occurs forcing the pawl 78 toward the ratchet 54 (in the direction of Arrow "D" in FIG. 3). This action substantially prevents inadvertent disengagement of the pawl 78 from the ratchet 54. The first portion 94 of the pawl 78 also includes (see FIGS. 4 and 8) cam surfaces 102 that are adapted to engage the trailing surfaces 70 of the ratchet teeth 62.

Figure 8:
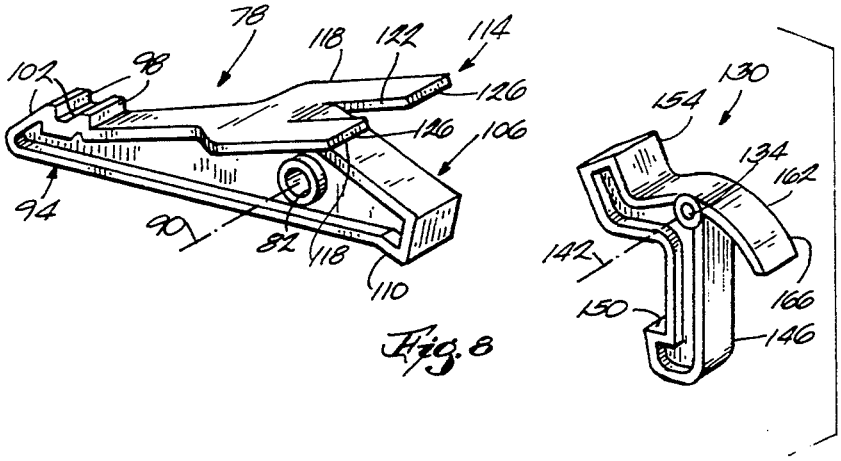
FIG. 8 is a perspective, exploded view of the pawl and latch of the chair shown in FIG. 1.

The pawl 78 also includes (see FIGS. 2 and 8) a second portion 106 which, relative to the pawl pivot axis 90, is opposite to the first portion 94. The second portion 106 provides a latch engaging surface 110. The pawl 78 also includes (see FIG. 8) a third portion or leaf spring 114 which is connected to the pawl 78 adjacent the bore 82 and which extends upwardly and rearwardly relative to the first portion 94 of the pawl 78. As best shown in FIG. 8, the leaf spring 114 includes a pair of spaced apart, generally parallel legs 118 which define therebetween a recess 122. The legs 118 are molded integrally (i.e., in one piece) with the remainder of the pawl 78. Each leg 118 has a distal end 126 that engages a portion of the frame 14 to bias the first portion 94 of the pawl 78 clockwise toward the ratchet 54. Thus, the leaf spring 114 comprises first resilient means for biasing the pawl 78 into engagement with the ratchet 54.

Figure 5:
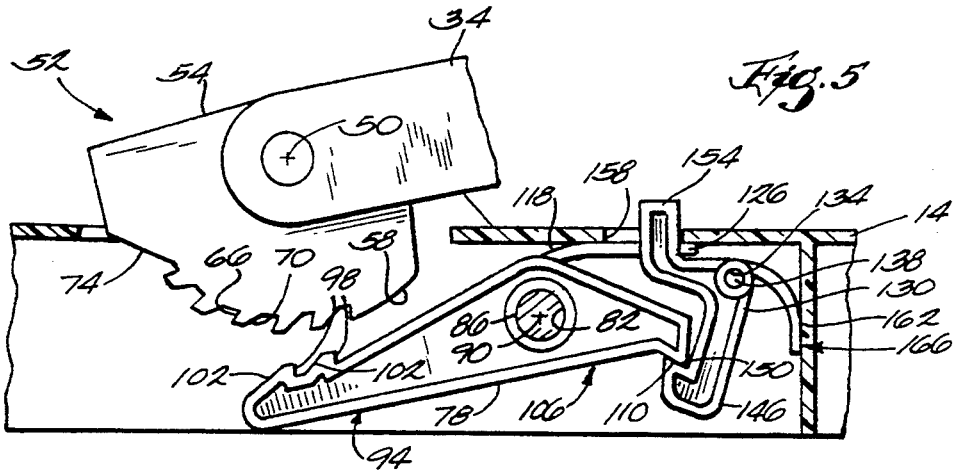
FIG. 5 is a view similar to FIG. 2 showing the backrest in a fourth position.

As shown in the drawings, the pawl 78 is moveable relative to the frame 14 and relative to the ratchet 54 between a first, engaged position (FIGS. 2 and 6) and a second, disengaged position (FIGS. 4 and 5). In the engaged position, each of the ratchet engaging surfaces 98 on the pawl 78 engages a respective leading face 66 of an associated ratchet tooth.

When the ratchet 54 and pawl 78 are engaged, the ratchet means 52 affords movement of the backrest 34 in the first direction (counterclockwise in the drawings) and prevents movement of the backrest 34 in the second, opposite direction (clockwise in the drawings). Specifically, when the ratchet 54 and pawl 78 are engaged as shown in FIG. 2, clockwise movement of the backrest 34 is prevented as the leading faces 66 of the ratchet teeth 62 mate with the ratchet engaging surfaces 98 of the pawl 78. The biasing force of the leaf spring 114 tends to move the first portion 94 of the pawl 78 toward the ratchet 54, and the engagement of the ratchet engaging surfaces 98 with the leading faces 66 prevents clockwise pivotal movement of the backrest 34.

As mentioned above, the ratchet means 52 also affords counterclockwise movement of the backrest 34 (as indicated by Arrow "A" in FIG. 3) from horizontal toward vertical. As best illustrated in FIG. 3, when the backrest 34 is so moved, the ratchet 54 moves in a direction indicated by Arrow "B". When this occurs, the trailing surfaces 70 of the ratchet teeth 62 slide along the cam surfaces 102 on the pawl 78, and the leading faces 66 of the ratchet teeth 62 move (in the direction of Arrow "B") away from the ratchet engaging surfaces 98 on the pawl 78.

The chair 10 also includes release means for disengaging the ratchet means 52 when the backrest 34 is moved into the upper position (FIG. 4) to afford free movement of the backrest 34. While various suitable constructions for the release means can be used, in the illustrated embodiment, the release means includes means for moving the pawl 78 counterclockwise and against the biasing force of the leaf spring 114 and completely out of engagement with the ratchet 54. The release means includes the cam surface 74 on the ratchet 54. When the cam surface 74 engages the first portion 94 of the pawl 78, the eccentric shape of the cam surface 74 moves the first portion 94 of the pawl 78 in the direction of Arrow "C" in FIG. 3 and pivots the pawl 78 counterclockwise about the pawl pivot axis 90. When the backrest 34 moves into its upper position, the pawl 78 moves against the bias of the leaf spring 114 into its disengaged position.

The release means also includes a latch 130 supported by the frame 14 for pivotal movement relative thereto between a first or unlatched position (FIG. 6) and a second or latched position (FIGS. 4 and 5). In its latched position, the latch 130 engages the second portion 106 of the pawl 78 and retains the pawl 78 in its disengaged position. In particular, and as best shown in FIGS. 2–5 and 8, the latch 130 is generally crank-shaped and has therein a bore 134 receiving a latch pin 138 that is fixed to the frame 14. The latch pin 138 supports the latch 130 for pivotal movement about a latch pivot axis 142 (FIG. 8 only) between the latched and unlatched positions. The latch pivot axis 142 is defined by the latch pin 138 and extends generally parallel to and is spaced from the pawl pivot axis 90.

The latch 130 has (see FIGS. 2 and 8) a first, generally hooked-shaped arm 146 extending downwardly from the latch pivot pin 138. The latch arm 146 includes an engaging surface 150 that engages the latch engaging surface 110 of the pawl 78 when the pawl 78 pivots to its disengaged position. Preferably, there is a negative draft angle on both the engaging surface 150 and on the latch engaging surface 110 so that, when the engaging surfaces 110 and 150 mate, the latch 130 securely retains the pawl 78 in its disengaged position.

The latch 130 also includes a second arm 154 which is generally L-shaped and which extends from a point adjacent the latch pivot pin 138 in a direction generally transverse to that of the first arm 146. For reasons discussed below, the second arm 154 extends through the recess 122 defined by the legs 118 of the leaf spring 114 and extends upwardly through an opening 158 (FIG. 2) in the frame 14.

The release means also includes means for biasing the latch 130 toward the latched position (i.e., clockwise in the drawings). While various suitable constructions for the latch biasing means could be used, in the illustrated embodiment, the latch biasing means includes a leaf-spring 162 that extends from the latch 130 adjacent the bore 134. The leaf spring 162 has a distal end 166 which engages the frame 14. The spring 162 is molded integrally (i.e., in one piece) with the remainder of the latch 130. The leaf spring 162 biases the latch 130 toward the latched position (clockwise in the direction of Arrow "F" in FIG. 4) so that the first arm 146 is moved toward the second portion 106 of the pawl 78.

Figure 6:
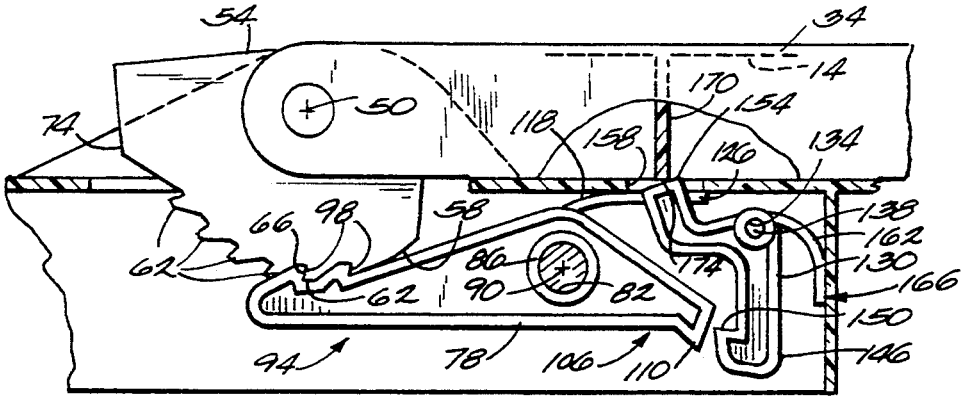
FIG. 6 is a view similar to FIG. 2 showing the backrest in a fifth position.

The chair 10 also includes latch engaging means located on the backrest 34. The latch engaging means is engageable with the latch 130 for moving the latch 130 into the unlatched position when the backrest 34 is moved to the lower position (shown in FIG. 6). While various suitable means for engaging the latch 130 can be employed, in the illustrated embodiment, the latch engaging means includes (see FIG. 6) a rib 170 having a lower surface or edge 174 which extends to the rearward surface of the backrest 34 so as to engage the second arm 154 of the latch 130 when the backrest 34 is moved into its lower position. When the backrest is in its lower position, as shown in FIG. 6, the rib 170 pushes downwardly on the portion of the second arm 154 extending above the upper surface of the frame 14 to pivot the latch 130 (counterclockwise in FIG. 5) from its latched position into its unlatched position. When the latch 130 is so pivoted, the first latch arm 146 moves counterclockwise and away from the second portion 106 of the pawl 78, thereby releasing the pawl. Subsequently, the pawl 78, by virtue of the bias of the leaf spring 114, snaps (clockwise) into engagement with the ratchet 54.

In operation, the backrest 34 of the chair 10 can be adjusted as follows:

The backrest 34 can be moved counterclockwise from any one of the positions in the range of positions. When the backrest is so moved, the pawl 78 allows movement of the ratchet 54 to afford such rotation of the backrest 34 about the hinge axis 50.

When the backrest 34 is moved to a near vertical position, i.e. the upper position (as shown in FIG. 4), the cam portion 74 of the ratchet 54 moves the first portion 94 of the pawl 78 downwardly away from the ratchet teeth 62, and pivots the pawl 78 counterclockwise against the bias of the leaf spring 114 from the engaged position to the disengaged position. When the pawl 78 is pivoted into the disengaged position, the second portion 106 of the pawl 78 is engaged by the latch 130 as the latch is forced by the leaf spring 162 to pivot clockwise into its latched position. The latch 130 thereafter retains the pawl 78 in the disengaged position allowing free movement of the backrest 34 in either direction about the hinge axis 50.

The ratchet means 52 is engaged to allow adjustment of the backrest 34 by moving the backrest into a horizontal position, i.e., the lower position, shown in FIG. 5. When the backrest 34 is in the horizontal position, the rib 170 on the backrest 34 engages the latch arm 154 and moves the latch 130 counterclockwise from the latched position toward the unlatched position to release the pawl 78. The pawl 78 then rotates (through action of the leaf spring 114) into engagement with the ratchet 54. Once the ratchet 54 is engaged, the backrest 34 is again movable counterclockwise toward an upright position but is prevented from clockwise movement until the backrest is returned to its upper position.

Various features of the invention are set forth in the following claims.

I claim:

1. Seating apparatus comprising a frame, a member supported by said frame for movement relative thereto, a ratchet mechanism for affording movement of said member relative to said frame in a first direction from a first extreme position through a range of positions to a second extreme position and for preventing movement of said member relative to said frame in a second direction opposite to said first direction, said ratchet mechanism including a ratchet, and a one-piece pawl including a first portion engageable with said ratchet and a resilient portion for biasing said pawl into engagement with said ratchet, said resilient portion of said pawl defining a recess, and a release mechanism for completely disengaging said ratchet and said pawl when said member is moved into said second extreme position, said release mechanism including a latch that is supported by said frame, a portion of said latch extending into said recess.

2. An apparatus as set forth in claim 1 wherein said frame supports said pawl for pivotal movement about a first pivot axis, wherein said release mechanism includes a latch that is supported by said frame for pivotal movement about a second pivot axis that is generally parallel to and is offset from said first pivot axis.

3. An apparatus as set forth in claim 1 wherein said ratchet is mounted on said member and said pawl is mounted on said frame.

4. Seating apparatus comprising a frame, a member supported by said frame for movement relative thereto, a ratchet mechanism for affording movement of said member relative to said frame in a first direction from a first extreme position through a range of positions to a second extreme position and for preventing movement of said member relative to said frame in a second direction opposite to said first direction, said ratchet mechanism including a ratchet, and a one-piece pawl including a first portion engageable with said ratchet and a resilient portion for biasing said pawl into engagement with said ratchet, and a release mechanism for completely disengaging said ratchet and said pawl when said member is moved into said second extreme position, said release mechanism including a one-piece latch supported for movement relative to said frame between an unlatched position and a latched position wherein said latch retains said pawl out of engagement with said ratchet, said latch including a first portion engageable with said pawl and a resilient portion for biasing said latch into engagement with said pawl.

5. An apparatus as set forth in claim 4 wherein said member and said latch are engageable when said member is in said first extreme position to move said latch out of said latched position.

6. An apparatus as set forth in claim 4 wherein said latch moves into said latched position when said pawl moves out of engagement with said ratchet.

7. An apparatus as set forth in claim 4 wherein said release mechanism includes a latch that is supported by said frame, wherein said resilient portion of said pawl defines a recess and wherein a portion of said latch extends into said recess.

8. An apparatus as set forth in claim 4 wherein said frame supports said pawl for pivotal movement about a first pivot axis, wherein said release mechanism includes a latch that is supported by said frame for pivotal movement about a second pivot axis that is generally parallel to and is offset from said first pivot axis.

9. An apparatus as set forth in claim 4 wherein said ratchet is mounted on said member and said pawl is mounted on said frame.

10. A chair comprising a frame, a backrest supported by said frame for pivotal movement relative thereto about a backrest axis, ratchet means for affording movement of said backrest relative to said frame in a first direction from a first extreme position through a range of positions to a second extreme position and for preventing movement of said backrest relative to said frame in a second direction opposite to said first direction, said ratchet means including a ratchet on one of said frame and said backrest, and a pawl supported by the other of said frame and said backrest for movement into and out of engagement with said ratchet, first resilient means for biasing said pawl into engagement with said ratchet, and release means for completely disengaging said ratchet and said pawl when said backrest is moved into said second extreme position and for affording free movement of said backrest through said range of positions, said release means including means for moving said pawl against said first resilient means and out of engagement with said ratchet, and said release means also including a latch supported by said frame for movement into and out of a latched position wherein said latch engages said pawl for retaining said pawl out of engagement with said ratchet, said latch being supported by said frame for pivotal movement relative thereto about a second axis spaced from said backrest axis, said backrest engaging said latch and moving said latch out of said latched position when said backrest is in said first extreme position.

11. A chair as set forth in claim 10 wherein said frame supports said pawl for pivotal movement about a first pivot axis between an engaged position wherein said ratchet and pawl are engaged and a disengaged position wherein said pawl is spaced away from said ratchet.

12. A chair as set forth in claim 10 wherein said pawl includes a first portion engageable with said ratchet and wherein said first resilient means includes a second portion of said pawl engaged with said frame.

13. A chair as set forth in claim 12 wherein said pawl is a one-piece element made by injection molding.

14. A chair as set forth in claim 10 wherein said frame supports said pawl for pivotal movement about a first pivot axis, and wherein said first and second pivot axes extend generally parallel to one another and are spaced from one another.

15. An apparatus as set forth in claim 10 wherein said ratchet is mounted on said backrest and said pawl is mounted on said frame.

16. A chair comprising a frame, a backrest supported by said frame for pivotal movement relative to said frame through a range of positions between a lower position and an upper position, a ratchet on said backrest, a pawl pivotally supported by said frame and moveable between an engaged position wherein said pawl engages said ratchet and prevents movement of said backrest relative to said frame toward said lower position and a disengaged position wherein said pawl is spaced away from said ratchet to afford free movement of said backrest through said range of positions, first resilient means for biasing said pawl toward said engaged position, means on said backrest for moving said pawl into said disengaged position when said backrest is in said upper position, a latch supported by said frame for movement between an unlatched position wherein said latch is disengaged from said pawl and a latched position wherein said latch retains said pawl in said disengaged position, second resilient means for biasing said latch toward said latched position, and means on said backrest for moving said latch into said unlatched position when said backrest is in said lower position.

17. A chair as set forth in claim 16 wherein said ratchet includes a cam portion, and wherein said means on said backrest for moving said pawl includes said cam portion.

18. A chair as set forth in claim 16 wherein said first resilient means for biasing said pawl defines a recess, and wherein said latch includes a portion extending into said recess.

19. A chair as set forth in claim 18 wherein said means on said backrest for moving said latch includes a portion of said backrest engageable with said portion of said latch extending into said recess.

20. A chair as set forth in claim 16 wherein said pawl includes a first portion that is engageable with said ratchet, a second portion engageable with said latch, and a third, resilient portion including said first resilient means.

21. A chair as set forth in claim 20 wherein said pawl is made by injection molding.

22. A chair as set forth in claim 16 wherein said latch includes a first portion engageable with said pawl, a second portion engageable with said backrest, and a third, resilient portion including said second resilient means.

23. A chair as set forth in claim 22 wherein said latch is made by injection molding.

24. A chair as set forth in claim 16 wherein said frame, backrest, ratchet, pawl, and latch are made of plastic.

* * * * *